US006933455B1

(12) United States Patent
Yu

(10) Patent No.: US 6,933,455 B1
(45) Date of Patent: Aug. 23, 2005

(54) CIRCUIT BREAKER ON A PUSHBUTTON SWITCH

(76) Inventor: Tsung-Mou Yu, No. 4, Alley 2, Lane 23, Sec. 3, Pa Te Road, Panchiao City, Taipei (TW)

( * ) Notice: Subject to any disclaimer, the term of this patent is extended or adjusted under 35 U.S.C. 154(b) by 0 days.

(21) Appl. No.: 10/835,406

(22) Filed: Apr. 28, 2004

(51) Int. Cl.[7] ..... H01H 21/00
(52) U.S. Cl. ..... 200/553; 200/339
(58) Field of Search ..... 200/5 A, 293, 200/329, 333, 334, 339, 556–559, 471, 472, 200/529; 337/51–56

(56) References Cited

U.S. PATENT DOCUMENTS 4,167,720 A 9/1979 Krasser ..... 337/60
4,937,548 A 6/1990 Sdunek ..... 337/70
5,223,813 A 6/1993 Cambreleng et al. ..... 337/66
5,262,748 A * 11/1993 Tsung-Mou ..... 337/66
5,451,729 A * 9/1995 Onderka et al. ..... 200/18
5,558,211 A 9/1996 Heydner et al. ..... 200/553
6,674,033 B1 * 1/2004 Wang ..... 200/334

* cited by examiner

*Primary Examiner*—Lisa N. Klaus

(57) ABSTRACT

A pushbutton switch has a pushbutton having a connection rod to be received in a connection hole defined in a distal end of the linkage which has a path in communication with the connection hole such that when the heat sensitive plate is reacted in response to heat caused by an electrical overload, the connection rod is able to move freely in the path in the linkage and thus the linkage is able to move without limitation.

5 Claims, 4 Drawing Sheets

(OFF)

(OFF)

(ON)

CIRCUIT BREAKER ON A PUSHBUTTON SWITCH

BACKGROUND OF THE INVENTION

1. Field of the Invention

The present invention relates to a circuit breaker, and more particularly to a circuit breaker on a pushbutton switch having a pushbutton pivotally mounted on the pushbutton switch to ensure a power disconnection in the circuitry when there is an overload.

2. Description of Related Art

The conventional circuit breaker uses a fuse between the switch and the circuit such that when there is an electrical overload, the fuse will first melt before the overload causes damage. However, when the fuse dimension is not proper to adapt to the voltage in the circuit, an electrical overload in the circuit will not melt the fuse and still causes disaster. Therefore, different measures are employed to ensure power cut-off in a dangerous situation. For example, U.S. Pat. Nos. 5,262,748; 4,167,720; 4,937,548; 5,223,813; 5,451,729 and 5,558,211 disclose circuit breakers of different types. Although the teachings of these patents are capable to automatically cause a temporary power outage, they still suffer problems, including:

(1) Too many elements: Because there are too many elements in the circuit breaker, the movement of the elements inside the circuit breaker is complex and complicated, which causes the manufacture cost high.

(2) Not real time movement of element: Because the number of elements, when there is an electrical overload in the circuit, sometimes, a heat sensitive plate usually used in the circuit breaker is not able to work properly to cause a temporary power outage. That is, normally the heat sensitive plate will curve toward a direction away from engagement with the contact to cause a temporary power outage. However, if the heat sensitive plate is not able to disengage with the contact in time or completely, the circuit will become overheat and thus a disaster happens.

The curvature movement of the heat sensitive plate to disengage with the contact while the temperature of the heat sensitive plate is over a predetermined temperature and the curvature movement of the heat sensitive plate to engage with the contact while the temperature of the heat sensitive plate is lower than the predetermined temperature often cause sparks, which easily causes a fire and malfunction to the electronic devices.

To overcome the shortcomings, the present invention intends to provide an improved circuit breaker to mitigate the aforementioned problems.

SUMMARY OF THE INVENTION

The primary objective of the invention is to provide an improved circuit breaker on a pushbutton switch such that the movement of the pushbutton in a first direction causes a movement of a linkage to drive a heat sensitive plate to engage with a contact that is formed on a terminal to have the circuit of the pushbutton switch completed. When there is an electrical overload in the pushbutton switch, the curvature movement of the sensitive plate causes the linkage to move into a space in the pushbutton such that the heat sensitive plate is disengaged with the contact and thus a temporary power outage is completed.

Other objects, advantages, and novel features of the invention will become more apparent from the following detailed description when taken in conjunction with the accompanying drawings.

BRIEF DESCRIPTION OF THE DRAWINGS

FIG. 2 is a schematic side plan view showing the internal arrangement of the pushbutton switch of the present invention when the pushbutton is switched on;

DETAILED DESCRIPTION OF PREFERRED EMBODIMENT

Figure 1:
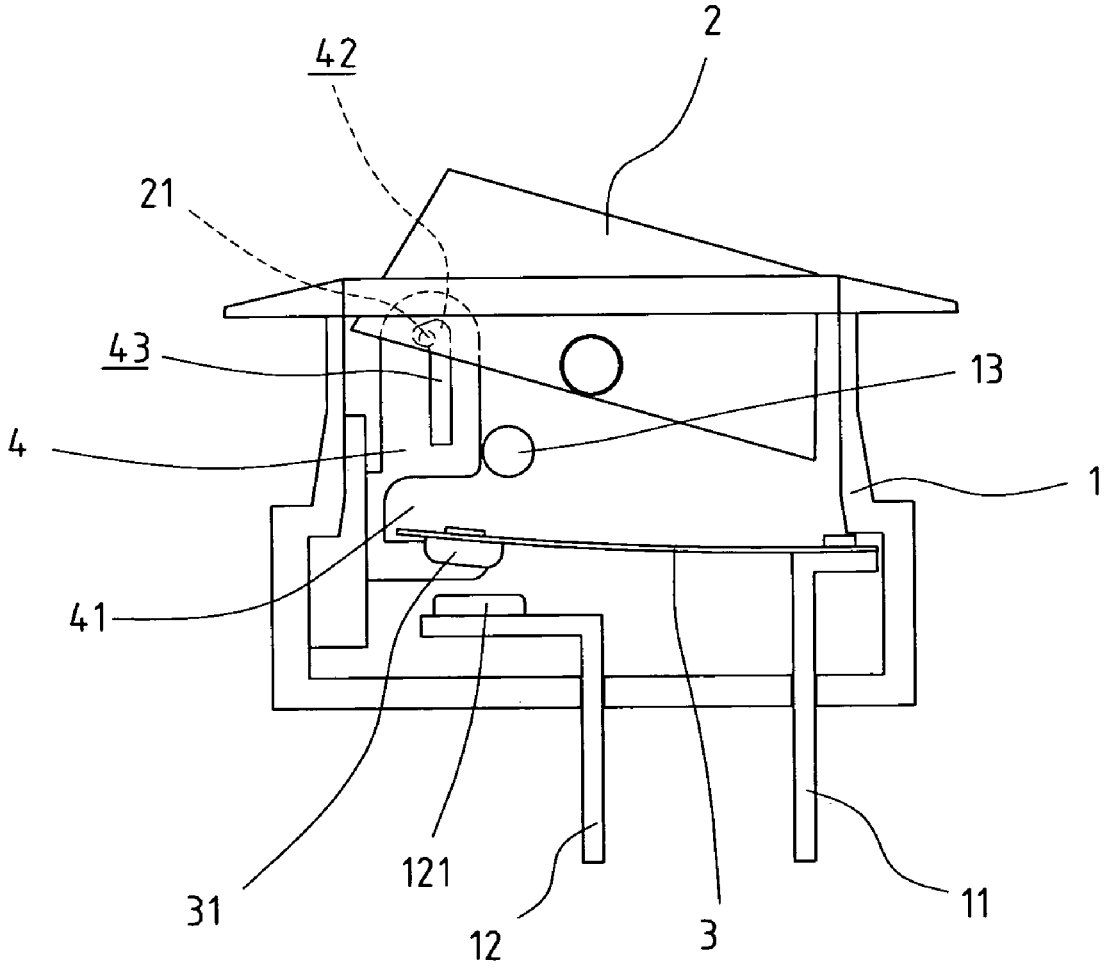
FIG. 1 is a schematic side plan view showing the internal arrangement of a pushbutton switch in accordance with the present invention when the pushbutton is switched off.
Figure 2:
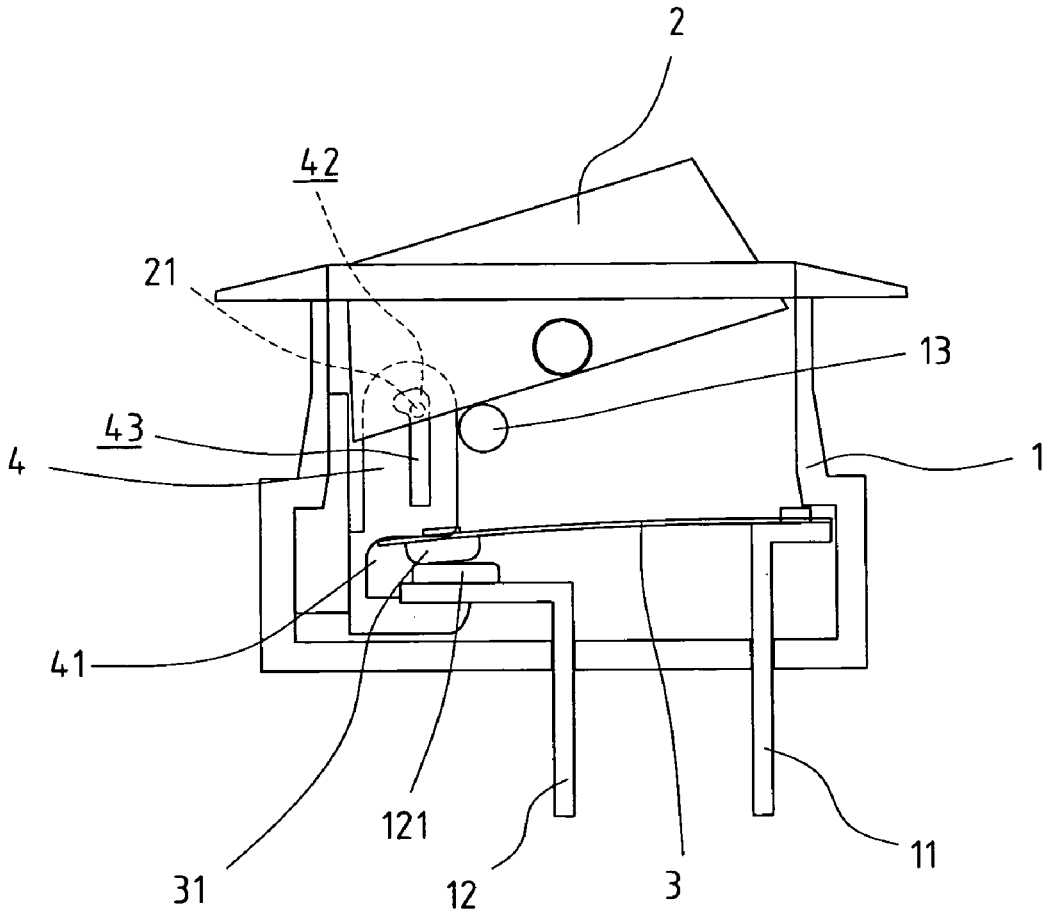
Figure 3:
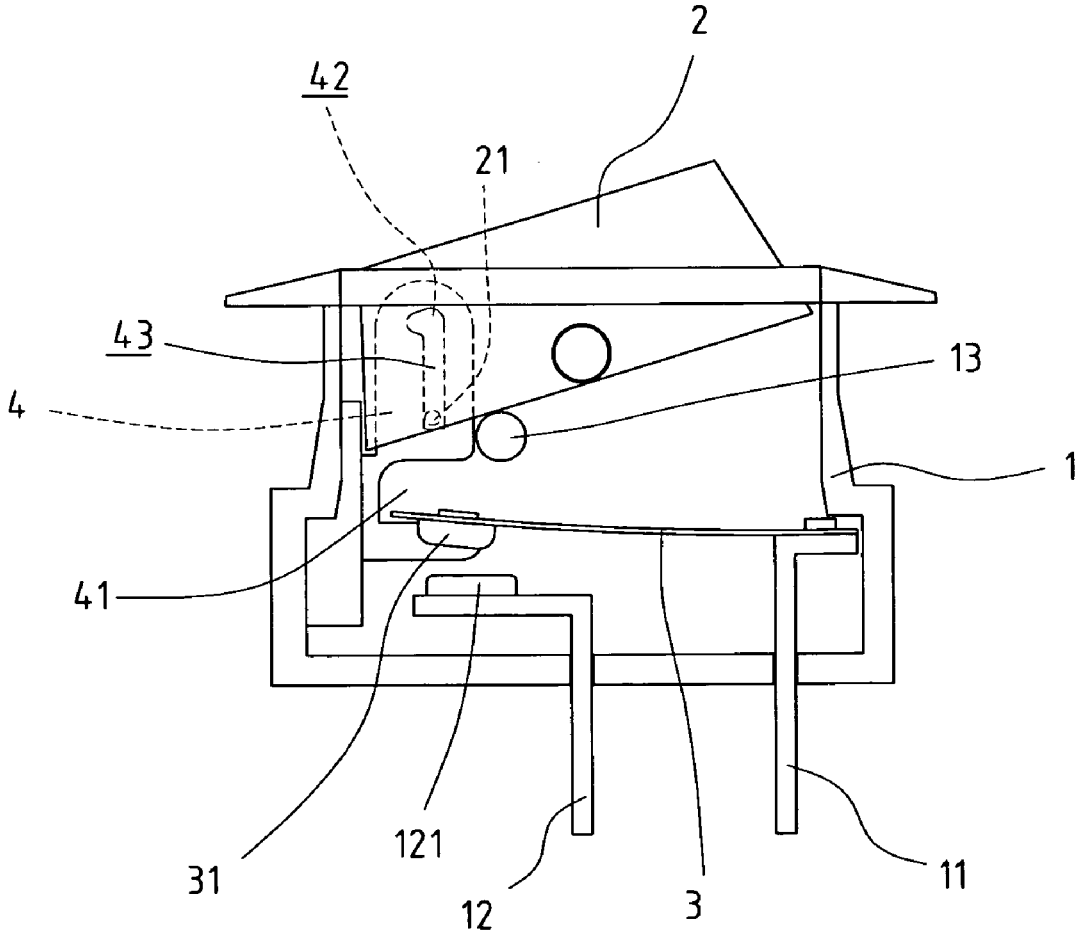
FIG. 3 is a schematic view showing the movement of the linkage when an overload occurs in the pushbutton switch of the present invention.

With reference to FIGS. 1–3, a pushbutton switch in accordance with the present invention includes a casing 1, a pushbutton 2, a heat sensitive plate 3, and a linkage 4.

The casing 1 is hollow and has an open end defined in a top portion of the casing 1. The casing 1 further has at least two terminals, namely a first terminal 11 and a second terminal 12. The first terminal 11 has a first distal end securely engaged with a distal end of the heat sensitive plate 3 and a second distal end extending out of a bottom face of the casing 1. The second terminal 12 has a first distal end provided with a first contact 121 formed on a bend (not numbered) on the first distal end of the second terminal 12 and a second distal end extending out from the bottom face of the casing 1. The second terminal 12 further has a guiding rod 13 formed on a side of the second terminal 12.

Figure 4:
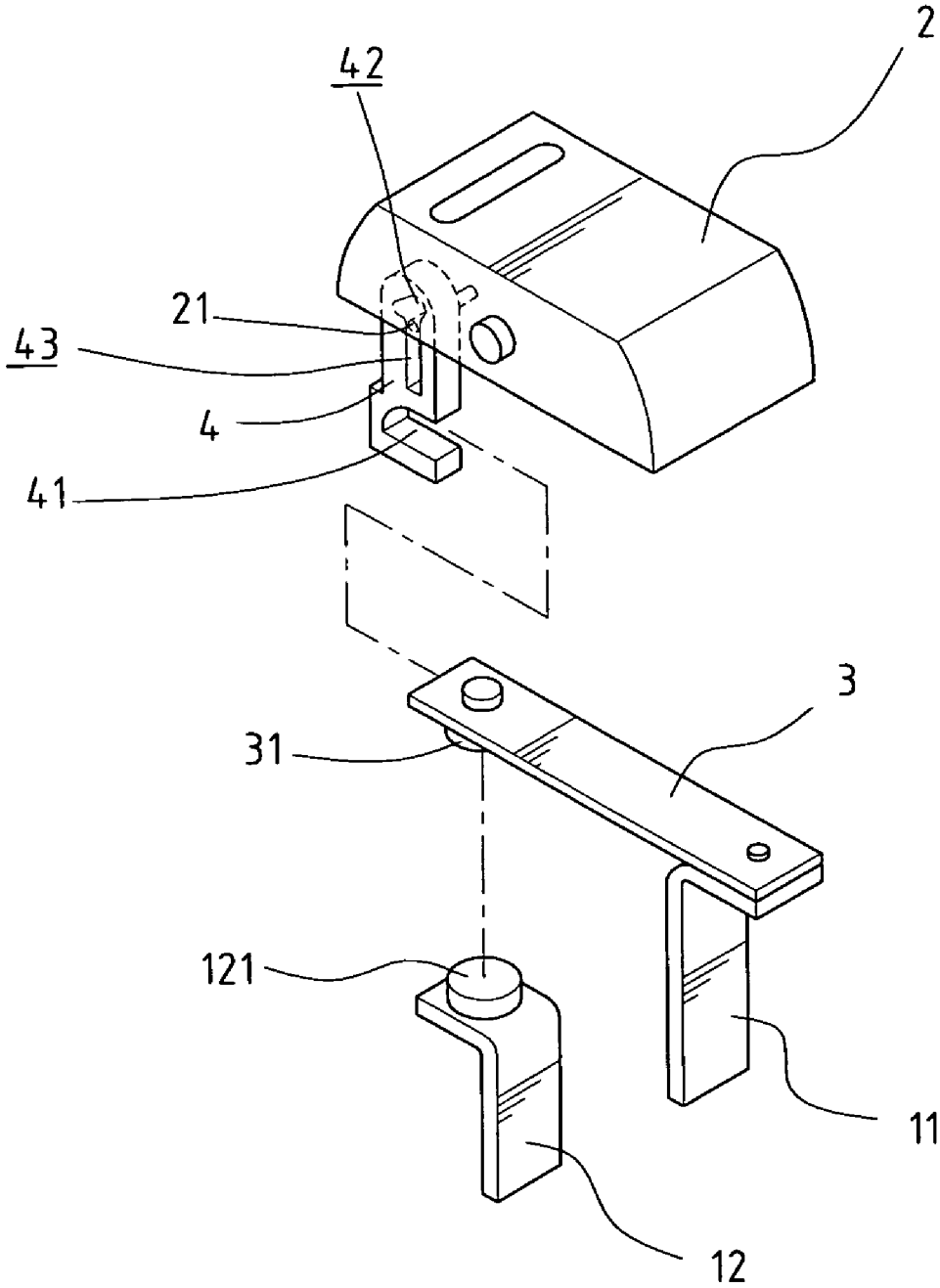
FIG. 4 is an exploded perspective view showing the structural relationship among the pushbutton, the linkage, the heat sensitive plate, and the terminal.

With reference to FIG. 4, it is noted that the pushbutton 2 is pivotally mounted on the casing 1 to cover the open end of the casing 1. The pushbutton 2 has a connection rod 21 formed in the pushbutton 2. The heat sensitive plate 3 has a first distal end securely connected to the first distal end of the first terminal 11 and a second distal end formed with a second contact 31 selectively engaged with the first contact 121 on the second terminal 12. The linkage 4 has a first distal end provided with a cutout 41 to correspond to and receive the second distal end of the heat sensitive plate 3 and a second distal end provided with a connection hole 42 corresponding to the connection rod 21 of the pushbutton 2 and a path 43 defined in a mediate portion of the linkage 4 and communicate with the connection hole 42.

When the pushbutton switch of the present invention is assembled, it is noted that the connection rod 21 of the pushbutton 2 is received in the connection hole 42 of the linkage 4 and the second distal end of the heat sensitive plate 3 is received in the cutout 41 of the linkage 4. The first and second terminals 11, 12 are extended out from the bottom face of the casing 1 for connection with a power source.

When the pushbutton 2 is pressed to cause the linkage 4 to move, the connection rod 21 travels in the path 43 of the linkage 4 freely and the second contact 31 on the second distal end of the heat sensitive plate 3 is in engagement with the first contact 121 on the second terminal 12, as shown in FIG. 2. However, when there is an electrical overload, the heat sensitive plate 3 reacts to heat and thus the heat sensitive plate 3 bends toward a direction causing the first contact 121 to be away from engagement with the second contact 31, which opens the circuit of the pushbutton switch of the present invention, as shown in FIG. 3. In the meantime, due to the curvature movement of the heat sensitive plate 3, the free end of the linkage 4 is pushed by the heat sensitive plate 3 to move toward the pushbutton 2 and the connection rod 21 is moved in the path 42. Thus the separation between the first contact 121 and the second contact 31 is ensured.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In a pushbutton switch having a pushbutton pivotally mounted on a hollow casing, a linkage movably received inside the casing and having a first distal end securely in contact with the pushbutton and a second distal end securely connected to a heat sensitive plate which is able to curve in reaction to heat and has a first distal end securely connected to a first distal end of a first terminal, wherein a second distal end of the first terminal extends out of the casing from a bottom face of the casing, a second terminal having a first distal end provided with a first contact mounted thereon and a second distal end extending out of the casing from the bottom face of the casing, wherein the heat sensitive plate has a second distal end provided with a second contact selectively in contact with the first contact, wherein the improvements comprises:

the pushbutton having a connection rod and the linkage having a connection hole defined in the first distal end thereof to receive therein the connection rod of the pushbutton.

2. The pushbutton switch as claimed in claim 1, wherein a cutout is defined in the second distal end of the linkage to receive a portion of the second distal end of the heat sensitive plate.

3. The pushbutton switch as claimed in claim 1, wherein a path is defined in a mediate portion of the linkage to communicate with the connection hole such that the connection rod of the pushbutton is able to move freely in the path when there is an electrical overload.

4. The pushbutton switch as claimed in claim 2, wherein a path is defined in a mediate portion of the linkage to communicate with the connection hole such that the connection rod of the pushbutton is able to move freely in the path when there is an electrical overload.

5. In a pushbutton switch having a pushbutton pivotally mounted on a hollow casing, a linkage movably received inside the casing and having a first distal end securely in contact with the pushbutton and a second distal end securely connected to a heat sensitive plate which is able to curve in reaction to heat and has a first distal end securely connected to a first distal end of a first terminal, wherein a second distal end of the first terminal extends out of the casing from a bottom face of the casing, a second terminal having a first distal end provided with a first contact mounted thereon and a second distal end extending out of the casing from the bottom face of the casing, wherein the heat sensitive plate has a second distal end provided with a second contact selectively in contact with the first contact, wherein the improvements comprises:

the pushbutton having a connection rod and the linkage having a connection hole defined in the first distal end thereof to receive therein the connection rod of the pushbutton, wherein a cutout is defined in the second distal end of the linkage to receive a portion of the second distal end of the heat sensitive plate, and a path is defined in a mediate portion of the linkage to communicate with the connection hole such that the connection rod of the pushbutton is able to move freely in the path when there is an electrical overload.

* * * * *